US007696846B2

(12) United States Patent
Maier et al.

(10) Patent No.: US 7,696,846 B2
(45) Date of Patent: Apr. 13, 2010

(54) ELECTROMAGNETIC SWITCHING DEVICE

(75) Inventors: Reinhard Maier, Herzogenaurach (DE); Erich Zerbian, Fensterbach (DE)

(73) Assignee: Siemens Aktiengesellschaft, Munich (DE)

( * ) Notice: Subject to any disclaimer, the term of this patent is extended or adjusted under 35 U.S.C. 154(b) by 1011 days.

(21) Appl. No.: 10/563,753

(22) PCT Filed: Jun. 8, 2004

(86) PCT No.: PCT/EP2004/006183

§ 371 (c)(1),
(2), (4) Date: Jan. 9, 2006

(87) PCT Pub. No.: WO2005/006371

PCT Pub. Date: Jan. 20, 2005

(65) Prior Publication Data

US 2006/0192643 A1 Aug. 31, 2006

(30) Foreign Application Priority Data

Jul. 10, 2003 (DE) ..... 103 31 339

(51) Int. Cl.
*H01H 9/30* (2006.01)

(52) U.S. Cl. ..... 335/201; 335/179; 335/278; 335/281

(58) Field of Classification Search ..... 335/260, 335/179, 201, 278, 281; 336/96
See application file for complete search history.

(56) References Cited

U.S. PATENT DOCUMENTS 3,959,758 A * 5/1976 Grobe ..... 335/153
5,243,313 A 9/1993 Basnett
5,580,396 A * 12/1996 Fruchart et al. ..... 148/101

FOREIGN PATENT DOCUMENTS

| | | | |
|---|---|---|---|
| DE | 41 29 265 | A1 | 3/1993 |
| DE | 295 06 744 | U1 | 8/1995 |
| DE | 195 06 168 | A1 | 8/1996 |
| DE | 197 00 521 | C2 | 7/1998 |
| DE | 198 06 720 | A1 | 8/1998 |
| DE | 197 35 271 | C2 | 2/1999 |
| DE | 100 16 318 | A1 | 10/2000 |
| DE | 100 31 923 | A1 | 1/2002 |
| DE | 101 26 854 | A1 | 12/2002 |
| DE | 102 02 476 | A1 | 8/2003 |
| EP | 0 505 194 | A1 | 9/1992 |
| EP | 0 720 194 | A1 | 7/1996 |
| EP | 0 959 484 | A2 | 11/1999 |
| FR | 2 809 860 | | 12/2001 |
| GB | 2 278 959 | | 12/1994 |
| JP | 04129124 | A * | 4/1992 |
| JP | 04248219 | A * | 9/1992 |
| WO | WO 01/41174 | A1 | 6/2001 |
| WO | WO 01/86682 | A2 | 11/2001 |

* cited by examiner

*Primary Examiner*—Ramon M Barrera
(74) *Attorney, Agent, or Firm*—Harness, Dickey & Pierce, P.L.C.

(57) ABSTRACT

A drive solenoid, a yoke, an armature and at least one contact are mounted in a housing of an electromagnetic switching device. The drive solenoid, yoke and armature are inductively intercoupled, in such a way that when an inrush current is applied to the drive solenoid, the armature can be displaced into a pickup position, thus directly or indirectly actuating the contact. The yoke and/or armature contain(s) pulverulent magnetic material.

16 Claims, 3 Drawing Sheets

ELECTROMAGNETIC SWITCHING DEVICE

This application is the national phase under 35 U.S.C. §371 of PCT International Application No. PCT/EP2004/006183 which has an International filing date of Jun. 8, 2004, which designated the United States of America and which claims priority on German Patent Application number DE 103 31 339.7 filed Jul. 10, 2003, the entire contents of which are hereby incorporated herein by reference.

FIELD

The present invention generally relates to an electromagnetic switching device. For example, it may relate to a contactor or a power circuit breaker, with a housing, a drive solenoid, a yoke, an armature and at least one contact,

- the drive solenoid, the yoke, the armature and the at least one contact being mounted in the housing,
- the drive solenoid, the yoke and the armature being inductively intercoupled, so that, when an inrush current is applied to the drive solenoid, the armature can be displaced into a pickup position,
- the displacement of the armature into the pickup position allowing the contact to be directly or indirectly actuated,
- the yoke containing pulverulent magnetic material.

BACKGROUND

Electromagnetic switching devices are known. By way of example, reference is made to EP-A-0 505 194.

Electromagnetic switching devices such as power circuit breakers and contactors contain magnetic drives which include a solenoid, a yoke and an armature. The yoke and the armature in this case consist of magnetizable material, for example iron sheets. If an inrush current is applied to the solenoid, a magnetic flux is produced in the yoke, exerts a force on the armature and picks it up. The armature is consequently displaced into a pickup position.

In the case of a contactor, the displacement of the armature has the effect that switching contacts connected to the armature are moved, and consequently main electrical contacts of the switching device are closed. Once application of the inrush current to the drive solenoid is completed, the armature is moved back into a starting position by restoring springs and, as a result, the contacts are opened.

In the case of power circuit breakers, magnetic trips in which a current to be monitored flows through the drive solenoid are used. If this current exceeds a predetermined value (that is to say the inrush current), the armature is displaced and, as a result, the breaker latching mechanism is actuated, which in turn brings about the opening of the contact.

In the prior art, the yoke and the armature include laminated cores which are produced from individual iron sheets that are connected to one another—for example by rivets. The production from individual metal sheets that are insulated from one another is necessary in this case in particular for the avoidance of eddy currents and associated eddy current losses.

In the prior art, it is disadvantageous in particular that, as a result of the sheeting, only limited degrees of freedom of form are possible and that the sheets can only be connected to the housing and actuating elements by appropriate fastening elements. The solenoid also has to be connected to the housing or the yoke by a separate insulating frame. Furthermore, in the prior art, the striking together of the yoke and armature has the effect of restricting the service life of the magnetic system.

It would be desirable for the yoke and the armature to be able to have any desired three-dimensional structures, which would make it possible for the magnetic circuits to be optimally configured. It should also be possible for the yoke, the drive solenoid and the housing to be connected to one another in a simple and low-cost way, in particular without additional fastening elements. Furthermore, there should be good thermal coupling, to allow any heat loss occurring to be dissipated and so-called hot spots to be avoided. Furthermore, the service life of the magnetic system should be just as long as the mechanical service life of the switching device.

SUMMARY

An object of at least one embodiment of the present invention is to develop an electromagnetic switching device in such a way that it may include, for example, at least one of these advantages.

The yoke and the drive solenoid are cast with each other by way of a permanently elastic casting compound to form a block. This is because that makes possible a simple, stable, durable and in particular low-cost connection of the yoke to the drive solenoid.

The pulverulent magnetic material may be, for example, a sintered material. Alternatively, it is possible for the pulverulent magnetic material to be mixed with a polymer compound, for example epoxy resin.

If the pulverulent magnetic material surrounds a soft iron core, a highly permeable material and/or a permanent magnet, a specifically directed flux guidance and/or bistable switching behavior can be achieved.

If a sensor which is inductively coupled to a conductor connected to the contact by way of a coupling element containing a pulverulent magnetic material is arranged in the housing, a sensor signal representative of the actual flow of current through the conductor can be determined in a simple way. The sensor may alternatively be formed as a magnetic field sensor or as a flux-change sensor.

If the sensor and the coupling element are cast with each other, the connection of the sensor to the coupling element is particularly durable and stable.

BRIEF DESCRIPTION OF THE DRAWINGS

Further advantages and details emerge from the following description of an example embodiment in conjunction with the drawings, in which, in basic representation, FIG. 1 schematically shows an electromagnetic switching device.

DETAILED DESCRIPTION OF THE EXAMPLE EMBODIMENTS

Figure 1:
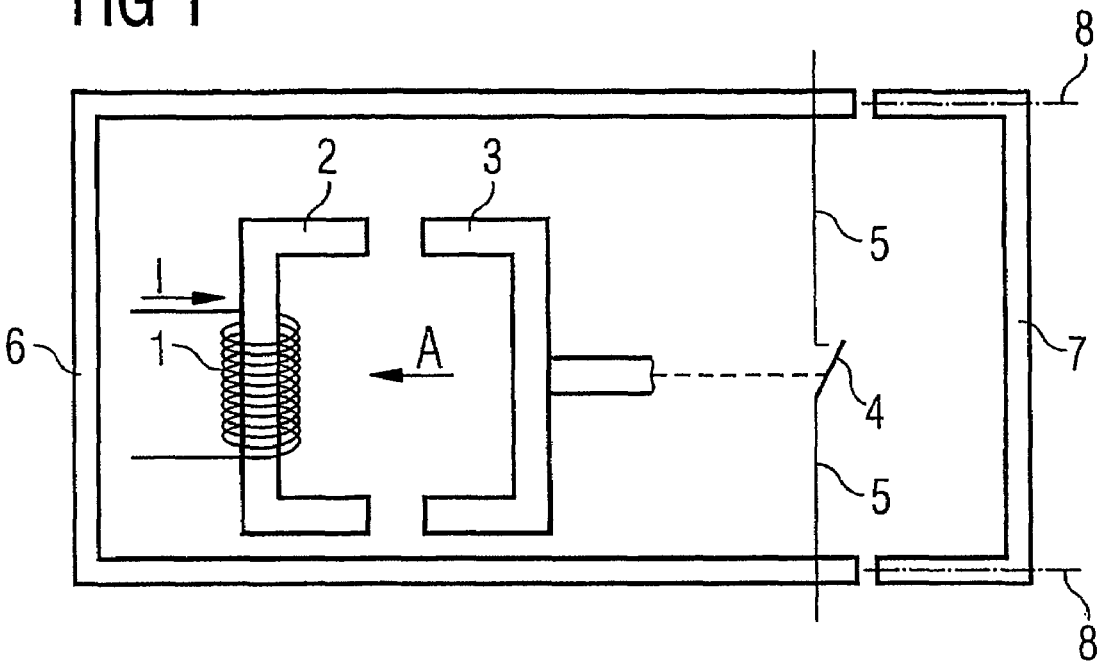

According to FIG. 1, a contactor, as the example of an electromagnetic switching device, has a drive solenoid 1. The drive solenoid 1 is inductively coupled to a yoke 2 and an armature 3. If an inrush current I is applied to the drive solenoid 1, the armature 3 is displaced into a pickup position, as indicated in FIG. 1 by an arrow A. One result of this is that the contact 4 is actuated, to be precise is closed. Therefore, an electrical connection is established between conductors 5 connected to the contact 4.

The drive solenoid 1, the yoke 2, the armature 3 and the contact 4 as well as the conductors 5 are mounted in a lower housing part 6. The lower housing part 6 is detachably connected to an upper housing part 7 by way of fastening elements 8, which are only schematically represented in FIG. 1. The lower housing part 6 and the upper housing part 7 together form a housing 6+7 of the electromagnetic switching device.

The construction described above for a contactor also applies in principle to the switching device formed as a power circuit breaker. The only difference is that, in the case of a power circuit breaker, the drive solenoid 1 is flowed through by a current to be monitored and the displacement of the armature 3 does not have the effect that a contact 4 is directly closed, but opened indirectly by actuation of a breaker latching mechanism. In this case, the electrical connection between the conductors 5 is therefore interrupted by the displacement of the armature 3.

The construction of the electromagnetic switching device from FIG. 1 is now explained in more detail below in conjunction with the sequence of FIGS. 2 to 5.

Figure 2:
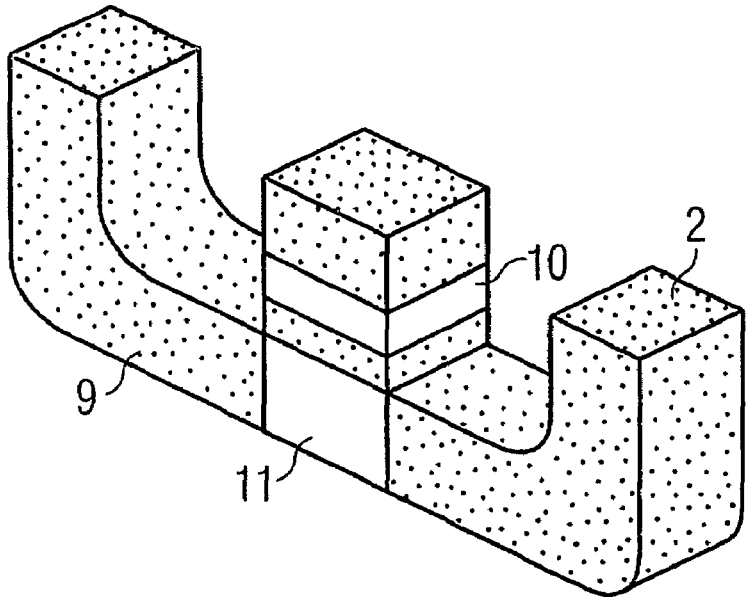
FIGS. 2 to 5 show steps in producing the electromagnetic switching device from FIG. 1

Firstly, the yoke 2 is produced in advance—see FIG. 2. It consists of pulverulent magnetic material 9 or contains such material 9. The pulverulent magnetic material 9 may be, for example, sintered material. The pulverulent magnetic material 9 may, however, also be a metallic powder which is mixed with a polymer compound, for example epoxy resin. As represented in FIG. 2, the yoke 2 may contain further elements 10, 11. For example, the yoke 2 may contain a permanent magnet 10. In this way it is possible, for example, to achieve a bistable switching behavior of the switching device. However, the yoke 2 may also contain a soft iron core 11 or some other highly permeable material. In this case, a specifically directed flux guidance of the magnetic field in the yoke 2 is obtained. The elements 10, 11 are surrounded at least on two sides, preferably at least on four sides, possibly even on all sides, by the pulverulent magnetic material 9.

Figure 3:
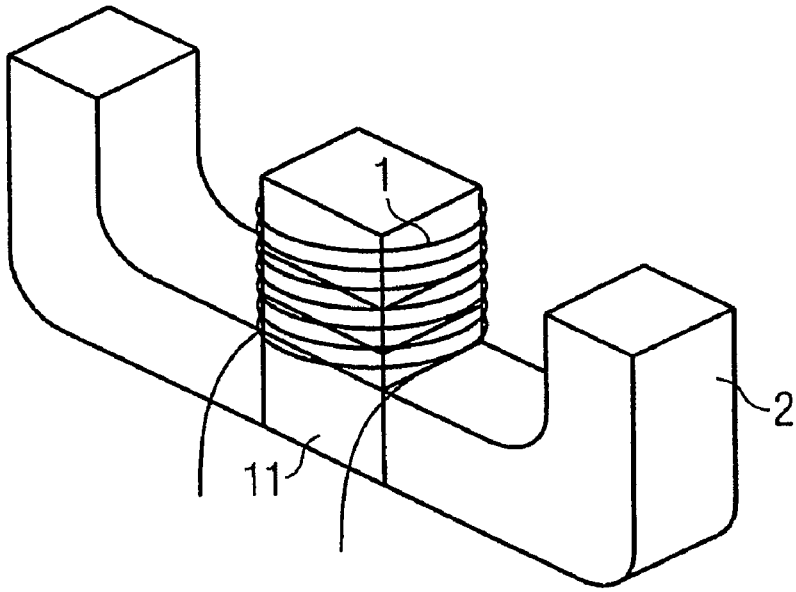
Figure 4:
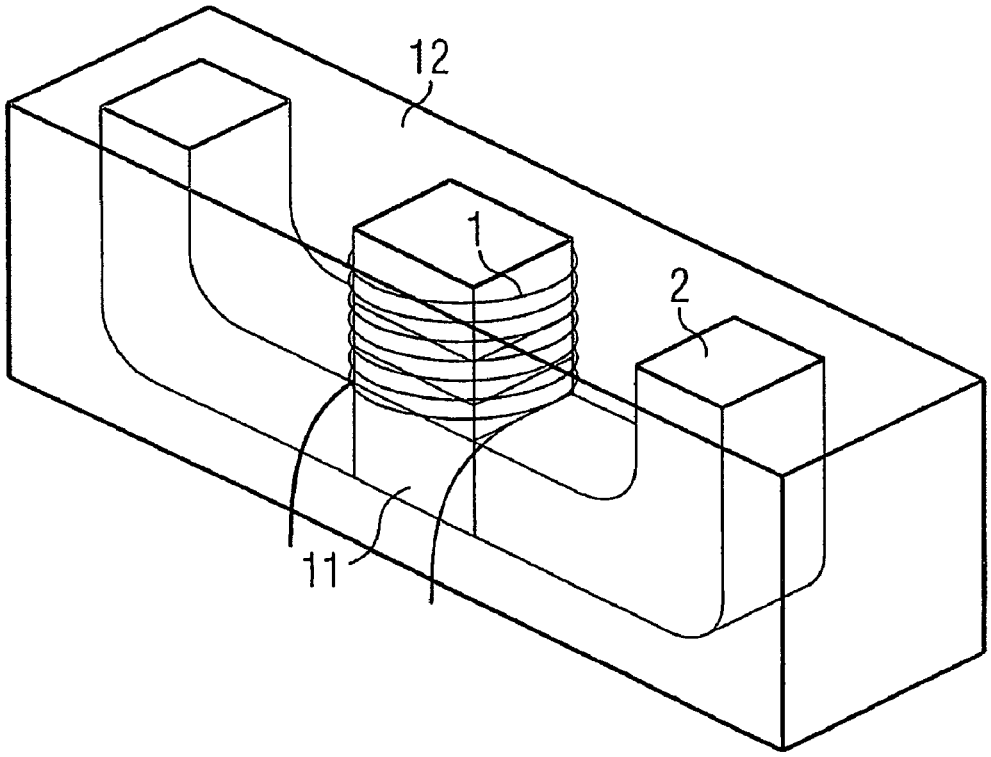

After producing the yoke 2, the drive solenoid 1 is loosely applied to the yoke—see FIG. 3. The drive solenoid 1 and the yoke 2 are then cast with each other—see FIG. 4—by means of a permanently elastic casting compound 12. The block of casting compound 12 is finally cast—see FIG. 5—with a hard casting material 13. The hard casting material 13 thereby forms at least part of the lower housing part 6.

The casting with the hard casting material 13 has the effect of producing at the same time an intimate bond between the lower housing part 6, the yoke 2 and the drive solenoid 1 by means of the permanently elastic casting compound 12. The drive solenoid 1, the yoke 2 and the lower housing part 6 are consequently cast with one another in a unitary manner by way of the casting compound 12.

Figure 5:
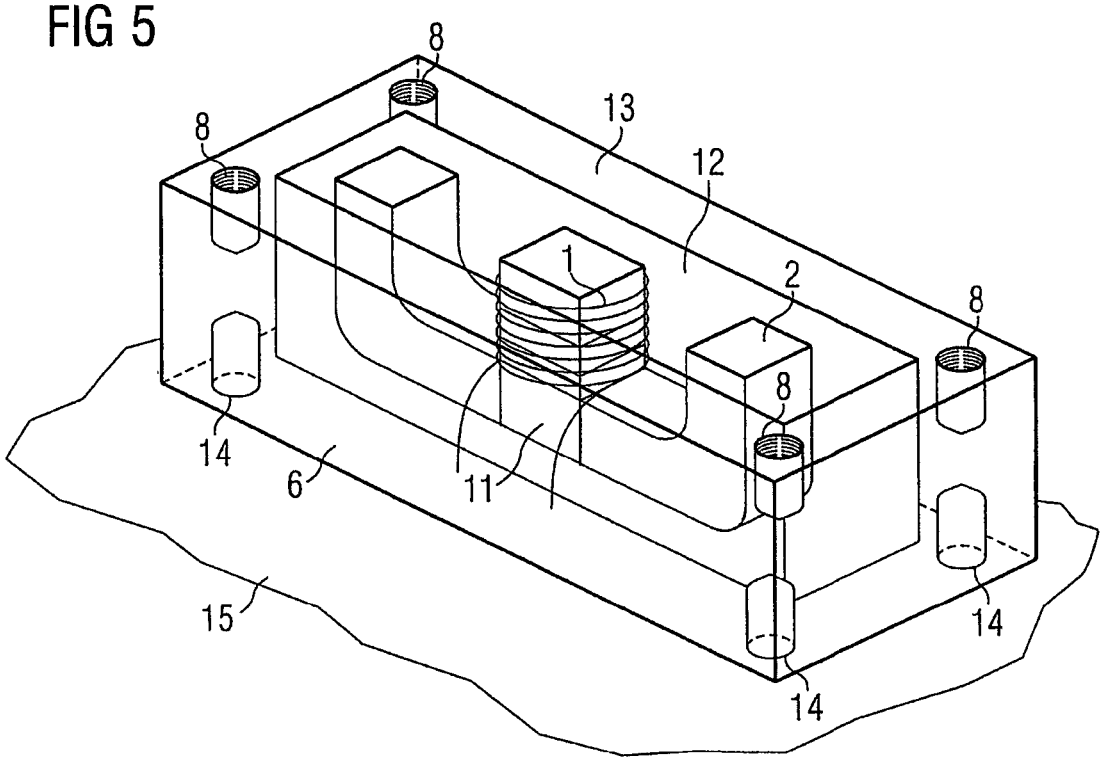

As can be seen from FIG. 5, the fastening elements 8 for connecting the lower housing part 6 to the upper housing part 7 are arranged on the lower housing part 6 in the casting material 13. Further fastening elements 14 are arranged in the casting material 13. By way of these fastening elements 14, the lower housing part 6 can be connected to a fastening surface 15, which is only schematically indicated in FIG. 5.

The production of the yoke 2 using the pulverulent magnetic material 9 and the lower housing part 6 of the hard casting material 13 has been described above. However, the above statements concerning the yoke 2 and the lower housing part 6 can be applied in an entirely analogous way to the production of the armature 3 and the upper housing part 7.

Figure 6:
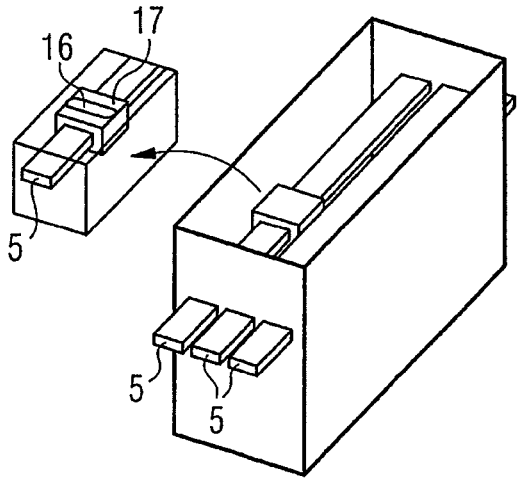
FIG. 6 shows a detail of an electromagnetic switching device.

FIG. 6 then shows an extension of the switching device of FIGS. 1 to 5. According to FIG. 6, a sensor 16 is arranged in housing 6+7. The sensor 16 is inductively coupled to one of the conductors 5 by way of a coupling element 17. By analogy with the yoke 2 and the armature 3, the coupling element 17 contains pulverulent magnetic material 9 or preferably even consists of such material. By way of the sensor 16, consequently a sensor signal that is representative of the current flow through the conductor 5 can be directly sensed.

As indicated in FIG. 6, the sensor 15 may be formed for example as a solenoid 16. In this case, the sensor 16 may be a flux-change sensor. It can therefore only be used in the case of alternating voltages or for detecting a switching operation. The sensor 16 may, however, also be formed as a magnetic field sensor, for example as a Hall sensor. In this case, the magnetic field as such, and consequently the current flow in the conductor 5, can be sensed by way of the sensor 16.

By analogy with the casting of the yoke 2 with the drive solenoid 1, the sensor 16 is preferably also cast with the coupling element 17, as schematically indicated in FIG. 6.

Consequently, entirely novel structures for the yoke 2 and the armature 3, even for the entire electromagnetic switching device, can be realized in a simple way by way of the switching device according to at least one embodiment of the invention.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An electromagnetic switching device, comprising:

a housing a drive solenoid;

a yoke;

an armature; and at least one contact, the drive solenoid, the yoke, the armature and the at least one contact being mounted in the housing, the drive solenoid, the yoke and the armature being inductively intercoupled, so that, when an inrush current is applied to the drive solenoid, the armature is displaceable into a pickup position, the displacement of the armature into the pickup position allowing the contact to be directly or indirectly actuated, the yoke containing pulverulent magnetic material, wherein the drive solenoid and the yoke are cast with each other by way of a permanently elastic casting compound to form a block, the housing comprises an upper housing part and a lower housing part, detachably connected to each other, wherein the lower housing part includes, at least partly, a casting material and wherein the drive solenoid and the yoke are connected to the casting material by way of the permanently elastic casting material and fastening elements for connecting the upper housing part to the lower housing part to each other are arranged in the casting material.

2. The switching device as claimed in claim 1, wherein the yoke and the housing are cast with each other by use of a casting compound.

3. The switching device as claimed in claim 2, wherein the drive solenoid, the yoke and the housing are cast with each other by use of a unitary casting compound.

4. The switching device as claimed in claim 1, wherein the casting material is a hard casting material.

5. The switching device as claimed in claim 4, wherein fastening elements for connecting the upper housing part to the lower housing part to each other are arranged in the casting material.

6. The switching device as claimed in claim 4, wherein fastening elements for connecting the lower housing part to a fastening surface are arranged in the lower housing part.

7. The switching device as claimed in claim 1, wherein fastening elements for connecting the lower housing part to a fastening surface are arranged in the lower housing part.

8. The switching device as claimed in claim 1, wherein the pulverulent magnetic material is sintered material.

9. The switching device as claimed in claim 1, wherein the pulverulent magnetic material is mixed with a polymer compound.

10. The switching device as claimed in claim 1, wherein fastening elements for connecting the lower housing part to a fastening surface are arranged in the lower housing part.

11. An electromagnetic switching device, comprising:

a housing a drive solenoid;

a yoke:

an armature; and at least one contact, the drive solenoid, the yoke, the armature and the at least one contact being mounted in the housing, the drive solenoid, the yoke and the armature being inductively intercoupled, so that, when an inrush current is applied to the drive solenoid, the armature is displaceable into a pickup position, the displacement of the armature into the pickup position allowing the contact to be directly or indirectly actuated, the yoke containing pulverulent magnetic material, wherein the drive solenoid and the yoke are cast with each other by way of a permanently elastic casting compound to form a block, and wherein the pulverulent magnetic material surrounds at least one of a soft iron core, a highly permeable material and a permanent magnet.

12. An electromagnetic switching device, comprising:

a housing a drive solenoid;

a yoke;

an armature; and at least one contact, the drive solenoid, the yoke, the armature and the at least one contact being mounted in the housing, the drive solenoid, the yoke and the armature being inductively intercoupled, so that, when an inrush current is applied to the drive solenoid, the armature is displaceable into a pickup position, the displacement of the armature into the pickup position allowing the contact to be directly or indirectly actuated, the yoke containing pulverulent magnetic material, wherein the drive solenoid and the yoke are cast with each other by way of a permanently elastic casting compound to form a block, and wherein a sensor, inductively coupled to a conductor connected to the contact by way of a coupling element containing a pulverulent magnetic material, is arranged in the housing.

13. The switching device as claimed in claim 12, wherein the sensor and the coupling element are cast with each other.

14. The switching device as claimed in claim 12, wherein the sensor is formed as at least one of a magnetic field sensor and a flux-change sensor.

15. The switching device as claimed in claim 14, wherein the sensor and the coupling element are cast with each other.

16. An electromagnetic switching device, comprising:

a housing a drive solenoid;

a yoke;

an armature; and at least one contact, the drive solenoid, the yoke, the armature and the at least one contact being mounted in the housing, the drive solenoid, the yoke and the armature being inductively intercoupled, so that, when an inrush current is applied to the drive solenoid, the armature is displaceable into a pickup position, the displacement of the armature into the pickup position allowing the contact to be directly or indirectly actuated, the yoke containing pulverulent magnetic material, wherein the drive solenoid and the yoke are cast with each other by way of a permanently elastic casting compound to form a block, and wherein the switching device is at least one of a contactor and a power circuit breaker.

* * * * *